United States Patent [19]

Allington

[11] 3,941,527

[45] Mar. 2, 1976

[54] ROTARY ENGINE

[76] Inventor: Jackson H. Allington, 3565 Pratt Road, Ann Arbor, Mich. 48103

[22] Filed: Oct. 29, 1974

[21] Appl. No.: 518,638

[52] U.S. Cl. ..... 418/196
[51] Int. Cl.[2] ..... F01C 1/08
[58] Field of Search ..... 418/196, 227

[56] References Cited

UNITED STATES PATENTS

| | | | |
|---|---|---|---|
| 453,935 | 6/1891 | Miessner | 418/196 |
| 597,793 | 1/1898 | Taylor | 418/196 |
| 660,017 | 10/1900 | Lambert | 418/196 |
| 723,436 | 3/1903 | Bayley | 418/196 |
| 2,690,164 | 9/1954 | Skok | 418/196 |
| 3,116,666 | 1/1964 | Scott | 418/196 |

*Primary Examiner*—John J. Vrablik
*Attorney, Agent, or Firm*—Whittemore, Hulbert & Belknap

[57] ABSTRACT

A rotary steam engine comprising a hollow cylindrical housing, a cylindrical rotor mounted concentrically within the housing having radially extending vanes rigidly secured thereto projecting between the rotor and the housing to form chambers therebetween in conjunction with the rotor and housing, a plurality of rotary valves carried in the housing and spaced angularly around the periphery of the rotor in rolling engagement with the rotor and having pockets therein for receiving the vanes as they pass through the valves, a gear train for synchronizing the rotation of the rotor and valves, means for passing fluid into the chambers between the rotor and housing and exhausting fluid therefrom positioned adjacent each of the valves, a rotation selector plate for porting the fluid under pressure into and exhausting the fluid from the chambers for selecting direction of rotation of the rotor, and a separate cutoff plate associated with each of the valves synchronized with the rotation of the valves for shutting off flow of fluid into the engine while the vanes pass through the valves.

7 Claims, 4 Drawing Figures

1
10
12
40
38
12
24
102
42
16
104
14
144
56
72
30
1

FIG. 3
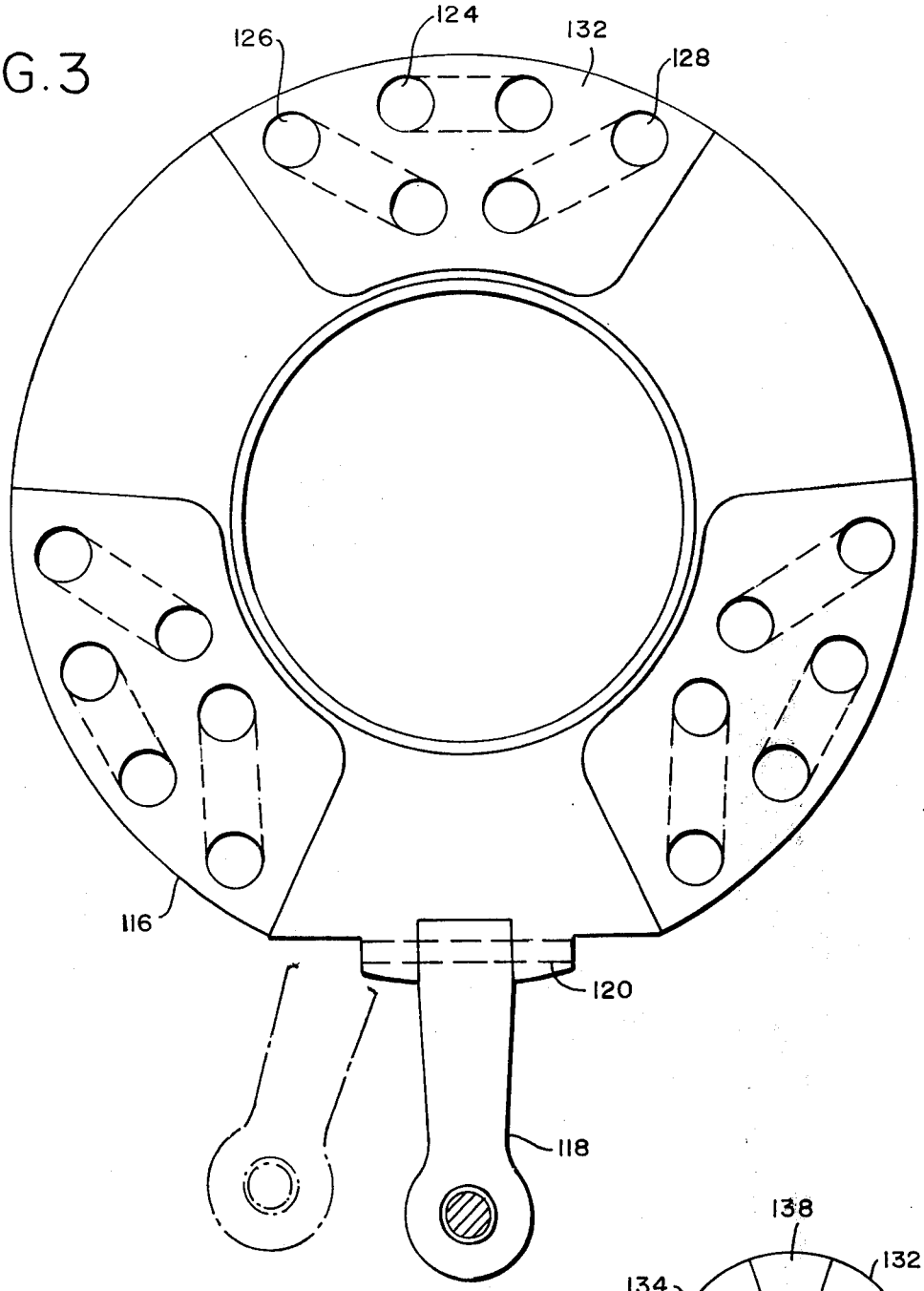
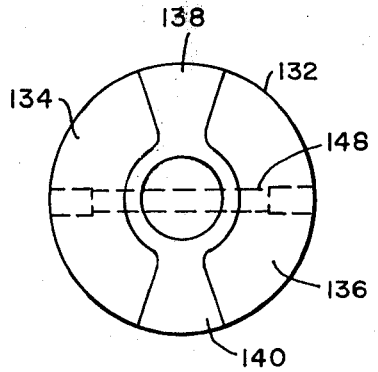
FIG. 4

ROTARY ENGINE

BACKGROUND OF THE INVENTION

1. Field of the Invention

The invention relates to engines and refers more specifically to a positive displacement rotary steam engine in which a cylindrical rotor having radially extending vanes rigidly secured thereto is caused to rotate in a hollow cylindrical housing by fluid passed into and out of the chambers formed by the rotor, vanes and housing through inlet and exhaust ports and wherein valve means adjacent the inlet and exhaust ports to the separate chambers seal the chambers and allow the vanes to pass through the valve means, which engine is completely reversible and is particularly simple and therefore economical to produce and efficient in operation.

2. Description of the Prior Art

In the past, rotary engines have often required the machining of particularly exotic shapes. Further, the parts of rotary engines in the past have generally not been symmetrical or have not been rotated about the center line thereof whereby rotation between the members of the engines has produced substantial vibration and excessive wear. Further, rotary engines have not all been reversible in the past. Also, a substantial amount of friction has been generated in prior rotary engines whereby heat and wear has been a particular problem in rotary engines of the past.

Wherein positive displacement rotary engines having a concentric housing and rotor have been produced in the past, the valving and porting of such engines has been particularly complicated and therefore expensive and often inefficient.

SUMMARY OF THE INVENTION

The rotary steam engine of the invention includes a hollow cylindrical housing, a cylindrical rotor mounted concentrically with the hollow cylindrical housing having a plurality of radially extending, angularly spaced vanes rigidly secured thereto forming chambers between the rotor, vanes and housing and porting structure for passing fluid under pressure into and out of the chambers at selected positions around the periphery of the rotor. The porting structure includes a selector plate which may be selectively positioned to provide forward, reverse or no operation of the engine.

Valves are provided at the selected positions for sealing the chambers and permitting passage of the vanes through the valves. In addition, a cutoff plate is provided in conjunction with each of the valves for preventing fluid input into the chamber associated with the valves while the vanes pass through the valves. The valves are synchronized for rotation with the rotor and are in rotary contact with the rotor.

BRIEF DESCRIPTION OF THE DRAWINGS

FIG. 3 is an elevation view of the selector plate of the rotary engine taken substantially on the line 3—3 in FIG. 1.

FIG. 4 is an elevation view of the cutoff plate of the rotary engine illustrated in FIG. 1 taken substantially on the line 4—4 in FIG. 1.

DESCRIPTION OF THE PREFERRED EMBODIMENT

Figure 1:
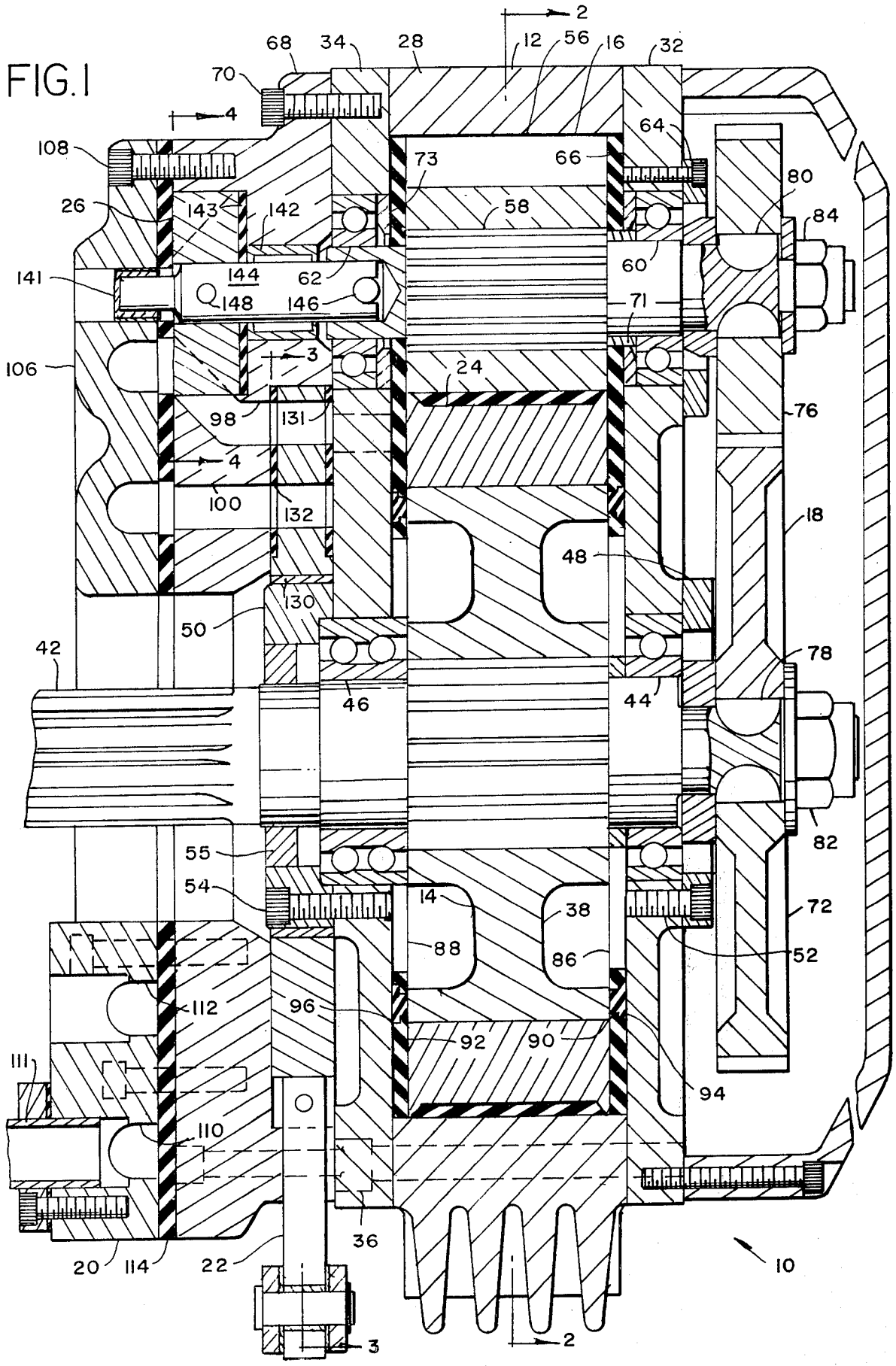
FIG. 1 is a section view of a rotary steam engine constructed in accordance with the invention and taken substantially on the line 1—1 in FIG. 2.

The rotary engine 10 illustrated in FIG. 1 includes a rotor housing 12, an engine rotor 14, valve structures 16, and means 18 for synchronizing rotation of the valve structures with the rotation of the rotor 14 in the housing 12.

The rotary engine 10 further includes inlet and exhaust means 20 for passing fluid into and exhausting fluid from the engine 10, selector structure 22 is provided for selecting the direction of rotation of the engine 10 while cutoff structure 26 is operable to cut off the fluid input to the engine 10 at valve structures 16 as the rotor vanes 24 pass through the valve structures 16.

More specifically, the housing 12 includes a hollow cylindrical member 28 having cooling fins 30 thereon as necessary. The housing 12 further includes the end plates 32 and 34 which are secured to the cylindrical member 28 by convenient means such as bolts 26.

Engine rotor 14 includes a cylindrical rotor body 38 to which radially extending rotor vanes 24 are rigidly secured by convenient means such as slots 40. The rotor 14 is mounted for rotation within the housing 12 and concentric therewith on the driven output shaft 42 by spline means as shown. Drive shaft 42 is journalled for rotation in the end plates 32 and 34 by the roller bearings 44 and 46. The bearings 44 and 46 are held in position by the bearing caps 48 and 50 and convenient bolts such as bolts 52 and 52. Seal 55 is provided adjacent bearing 46.

Figure 2:
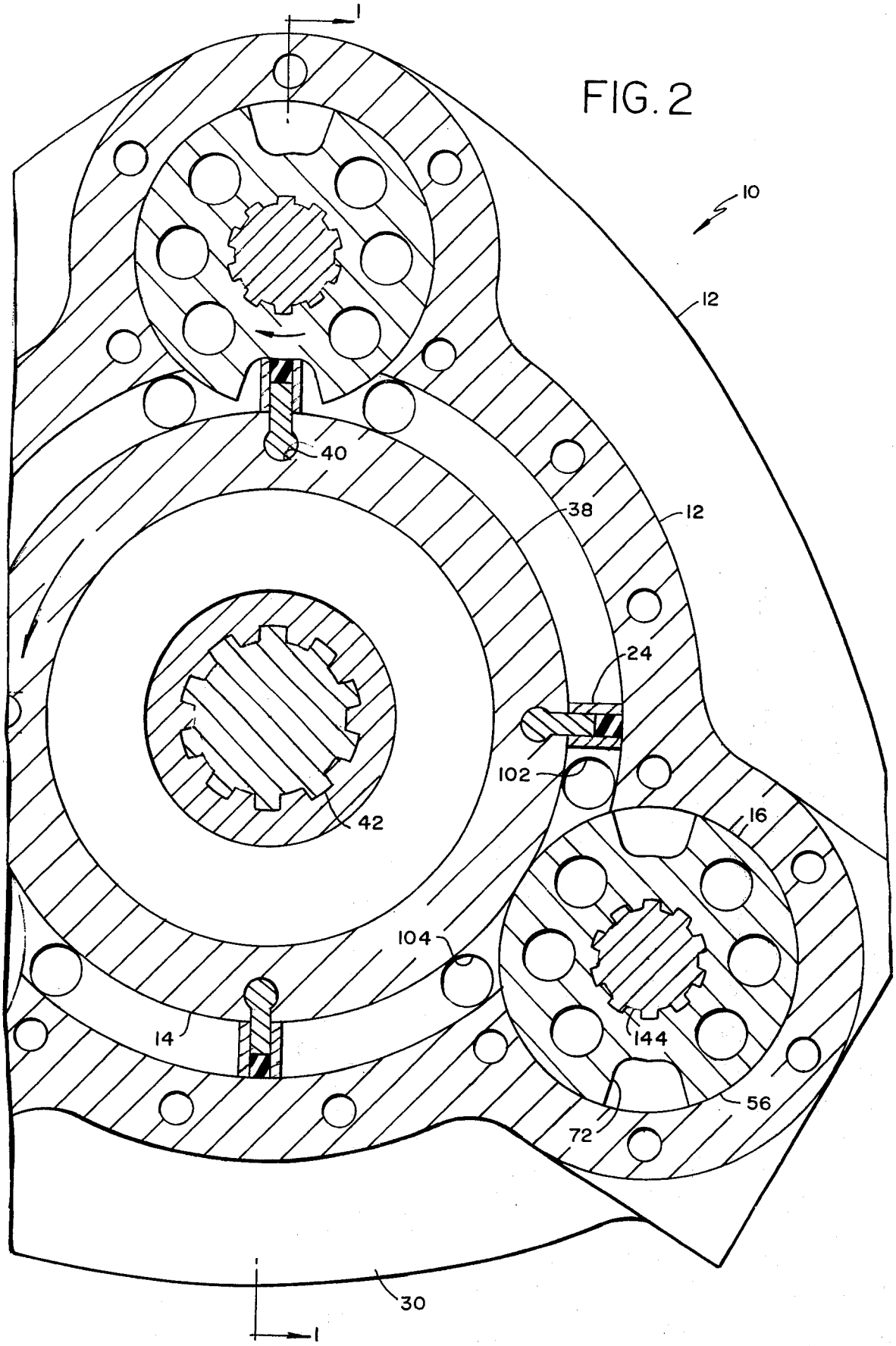
FIG. 2 is another section view of the rotary engine of the invention taken substantially on the line 2—2 in FIG. 1.

The valve structures 16 of which there are three as shown best in FIG. 2, positioned annularly about the rotor 14, each includes a rotor valve 56 mounted for rotation on a shaft 58 to which it is connected by spline means as shown. The shaft 58 is journalled for rotation in bearings 60 and 62 in the housing end plates 32 and 34. The bearing 60 is secured in the plate 32 by means of the bearing cap 64 and bolts 66. The bearing 62 is secured in the end plate 34 by the housing member 68 and convenient bolts 70. Spacers 71 and 73 are provided in conjunction with bearings 60 and 62 as shown in FIG. 1.

As shown best in FIG. 2, the rotor valves 56 are provided with a pair of oppositely disposed pockets 72 which receive the vanes 24 as the vanes pass through the valve structures 16. In operation, the rotor valves 56 are in rotary sealing engagement with the engine rotor 16 except when the vanes 24 pass through the valve structures in the pockets 72.

The rotation of the rotor valves 56 is synchronized with the rotation of the engine rotor 14 so that the vanes 24 pass through valve structures 16 only when the pockets 72 and vanes 24 are in alignment. The synchronizing of the rotation of the engine rotor 14 and the valve structures 16 is accomplished by the synchronizing means 18. The synchronizing means 18 includes the gear 74 in mesh with separate gears 76 associated with each valve structure 16. The gears 74 and 76 are keyed to the shafts 42 and 58 for rotation therewith by means of keys 78 and 80 and are secured to the shafts 42 and 58 by the nut and washer assemblies 82 and 84. Cover plate 84 is secured to end plate 32 over gears 74 and 76 by bolts 87 as shown.

Sealing is provided between the rotor body 38 and the end plates by the gasket members 86 and 88 and the annular seals 90 and 92 carried therein. The seals 90 and 92 are urged toward the rotor by wavy, that is, non-flat, spring means 94 and 96 in annular pockets in the seals 90 and 92.

The inlet and exhaust means 20 for pressing fluid such as low pressure steam into the engine 10 and providing exhaust for the engine 10 comprises the housing member 68, which as indicated before is secured to the end plate 34 by convenient means such as bolts 70, has inlet passages 98 and outlet passages 100 extending therethrough which are aligned with ports 102 and 104 in the end plate 34 adjacent each of the valve structures 16 as shown in FIG. 2.

The structure 20 further includes the cover plate 106 secured to the housing member 68 by convenient means such as the bolts 108 and has an annular inlet passage 110 and an annular outlet passage 112 therein aligned with the passages 98 and 100 in the housing member 68. Convenient coupling means 111, shown diagrammatically, may be provided for feeding low pressure steam or other motive fluid into the passage 110 through the passage 98 and passage 102 or 104 for driving the engine and out of the ports 102 or 104 and passages 100 and 112 for exhaust from the engine 10. Again, a sealing gasket 114 is provided between the end plate 106 and housing member 68.

The structure 22 for selecting the direction of rotation of the engine 10 includes the rotor selector plate 116 shown best in FIG. 3. The annular plate 116 includes a radially extending lever arm 118 secured thereto by convenient means such as pin 120 and may be connected to a shifting linkage 122 by pin 124.

The selector plate 116 includes a plurality of openings 124, 126 and 128 therethrough, as shown in FIG. 3, in conjunction with each of the valves 16 and pair of ports 102 and 104. The openings 124, 126 and 128 are operable in one angular position of the selector plate 116 to prevent fluid flow to the engine 10. On rotation of the selector plate in one direction as, for example, shown in phantom in FIG. 3, the openings 124, 126 and 128 align so as to pass fluid into port 104 in the end plate 34 and out of port 102 to provide clockwise rotation of the engine rotor 14. On rotation of the plate 116 in the opposite direction, fluid is caused to pass into the engine 10 through the port 102 and out of the engine 10 through port 104 to drive the engine in a reverse direction.

The selector plate 116 is mounted for rotation between the end plate 34 and the housing member 68 on the bearing 130. Sealing gaskets 131 and 132 are provided in conjunction with openings 124, 126 and 128 in selector plate 116 as shown in FIGS. 1 and 3.

The cutoff structure 26 includes the annular cutoff plate 132 as shown in FIG. 4 and which has one side 134 and 136 including portions which are sloped as shown best in FIG. 1 to provide an inlet passage for fluid to drive the engine 10 from the passage 110 to the passage 98 during most of the angular rotation of the cutoff plate 132. During that time when the vane is passing through the rotor valve pocket 72, the portions 138 or 140 of the cutoff plate 132 prevent drive fluid from entering the engine 10.

The cutoff plate 132 is mounted for rotation on the bearings 141 and 142 in the housing member 68 on shaft 144. The shaft 144 is driven in synchronism with the shaft 58 through the pin and slot structure 146 while the cutoff plate 132 is rigidly secured to the shaft 144 by the pin 148. A gasket 143 and the gasket 114 seals the opposite sides of the cutoff plate 132.

In overall operation of the engine 10, when the selector plate is in a neutral position, no drive fluid is permitted to pass between the passages 110 and 98 and the passages 102 or 104. In this state, the engine rotor 14 does not rotate with respect to the housing 12.

On rotation of the selector plate in one direction, fluid is allowed to pass from the structure 111 into the annular passage 110, through the passage 98 and through the aligned passage 124, is caused to pass into, for example, the ports 104 and into the chambers between the rotor 14 and housing 12. At the same time, fluid is permitted to pass out of the ports 102 through the aligned passage 126 and into the opening 100 and is exhausted through the opening 112. Thus, a positive displacement drive is provided for the rotor in a clockwise direction as long as the selector plate is in the position shown in FIG. 3.

As the rotor 14 rotates, the valve rotors 56 are driven through the gear train including the gears 74 and 76 to permit the vanes 24 to pass through the rotor valves 56 in the pockets 72. As the vanes pass through the rotor valves 56, the cutoff plate 132 is rotated to place the portions 138 or 140 in registry with the passage 98 to prevent feeding of fluid under pressure to the engine while the vanes 24 are passing through the pockets 72.

Should rotation of the engine in the opposite direction be desired, the selector plate 116 is rotated in the opposite angular direction to reverse the feeding of the ports 102 and 104 associated with the valve structures 16. At this time, fluid enters passage 124 and is exhausted through passage 128.

From the above disclosure it can be seen that the rotary steam engine of the invention is a positive displacement constant torque engine which provides a true rotary motion with parts which are easily machinable and which can be assembled without difficulty to provide required operating parameters inexpensively. In this regard, it should be noted that all rotating parts of the engine are symmetrical, bores are circular and ball bearings are provided on the driven shaft and all valves to reduce wear and friction. Further, the rotary steam engine disclosed herein may be produced from non-critical materials due to low operating temperature as compared to most turbine operation. Also, the engine 10 has a low noise level as a result of the use of low pressures and low velocity exhaust in the engine. Further, the engine of the invention has minimum power loss due to integral manifolding and the engine is 100 percent reversible with no reverse gears or clutch and transmission required. The engine has only four basic moving parts. Also, the engine rotor of the engine disclosed possesses inherent flywheel characteristics eliminating the need for a separate flywheel. In addition, in the engine disclosed, at least two rotor vanes are driving the rotor at all times and due to the diameter ratios of the engine rotor 14 and rotor valves 56 and the ratio of gears 74 and 76 the rotors are in one to one rolling contact to effect a friction-free rolling seal, the efficiency is equal in either direction of rotation of the engine 10, and the sealing is such as to not only reduce friction but to also reduce emissions.

While one embodiment of the present invention has been considered in detail, it will be understood that other embodiments and modifications thereof are contemplated. It is the intention to include all embodiments and modifications of the invention as are defined by the appended claims within the scope of the invention.

What I claim as my invention is:

1. A rotary engine comprising a hollow cylindrical housing having a circular opening therethrough, separate end plates secured to the housing over the opposite ends of the circular opening therethrough, a drive shaft journaled for rotation in the end plates and extending axially of the circular opening through the cylindrical housing, a cylindrical engine rotor concentrically mounted in the housing on the drive shaft for rotation in the cylindrical opening through the housing between the end plates with the drive shaft, a plurality of vanes mounted on the rotor extending radially outwardly therefrom and connected rigidly thereto to form a plurality of separate chambers between the rotor, housing, end plates and vanes, a plurality of rotary valve structures journaled for rotation in the end plates positioned angularly about the periphery of the rotor for sealing between the rotor and housing and permitting passing of the vanes therethrough, fluid inlet and outlet passages in one end plate adjacent the valve structures for permitting intake and exhaust of driving fluid into and out of the separate chambers, a separate housing member secured to the one end plate and a cover plate secured to the separate housing member, said separate housing member and cover plate together forming further inlet and outlet passages for driving fluid in communication with the inlet and outlet passages in the one end plate, a selector plate positioned between the one end plate and further housing member, said selector plate being rotatably mounted and having additional inlet and exhaust passages extending therethrough for reversing flow between the further inlet and exhaust passages in the cover plate and further housing member and the inlet and exhaust passages in the one end plate, and separate cutoff plates secured to and associated with each of the valve structures for rotation therewith and operably associated with the further inlet passage in the further housing member for cutting off the further inlet passage in the further housing member associated with the associated valve structure during passage of a vane through the associated valve structure, and drive means connected to the drive shaft and the individual valve structures for synchronizing the rotation of the individual valve structures and the rotor, and means for introducing fluid under pressure into the further inlet passage whereby the rotor, drive shaft, valve means and cutoff plate are synchronously driven.

2. Structure as set forth in claim 1 wherein the selector plate includes two exhaust passages therein having their end radially displaced from each other and converging toward each other radially inwardly of the selector plate and a single inlet passage having spaced apart opposite ends at the same radial position as the radially outer ends of the exhaust passages and between the outer ends of the exhaust passages associated with each separate valve structure whereby the radially outer end of one exhaust passage and the end of the inlet passage furthest removed from the radially outer end of the one exhaust passage are in engagement with the inlet and exhaust passages of the one end plate at each valve structure for permitting rotating the rotor in one angular direction and wherein the other end of the inlet passage and the radially outer end of the other exhaust passage are in engagement with the inlet and exhaust passages of the one end plate with the selector plate angularly positioned to permit rotating the rotor in a direction reverse to the one angular direction.

3. Structure as set forth in claim 1 wherein each cutoff plate is rigidly secured to a shaft journaled for rotation in the cover plate and housing member and includes recesses in the sides thereof operable to permit flow of fluid through the further inlet passage in the further housing member with the cutoff plate in predetermined angular positions and intermediate portions around the periphery of the cutoff plate having no recesses in the sides thereof whereby the further inlet passage in the further housing member is blocked in predetermined angular positions of the cutoff plate.

4. Structure as set forth in claim 1 wherein the valve structures are cylindrical members having longitudinally extending recesses therein for receiving the vanes therein in sealing engagement as the vanes pass through the valve structures.

5. Structure as set forth in claim 4 wherein there are four vanes on the rotor and three valve structures positioned 120° apart around the periphery of the rotor.

6. Structure as set forth in claim 5 wherein the drive means are engaged bevel gears having a drive ratio whereby the cylindrical body members of the valve structures and the rotor are driven in one to one rolling sealing engagement.

7. Structure as set forth in claim 6 wherein the vanes are substantially flat members extending longitudinally of the opening through the cylindrical housing between the cylindrical housing and rotor, one side of which are in sealing engagement with the cylindrical housing and the other side of which has a generally circular cross section positioned within a longitudinal slot in the rotor having a similar circular cross section at the bottom thereof.

* * * * *